US007548147B2

(12) United States Patent
Chiang

(10) Patent No.: US 7,548,147 B2
(45) Date of Patent: Jun. 16, 2009

(54) SWITCH TYPE ON/OFF STRUCTURE FOR HOISTING MAGNETIC DISKS

(75) Inventor: Wen-Hsuan Chiang, Taichung (TW)

(73) Assignee: Guang Dar Magnet Industrial Ltd., Taichung (TW)

( * ) Notice: Subject to any disclaimer, the term of this patent is extended or adjusted under 35 U.S.C. 154(b) by 114 days.

(21) Appl. No.: 11/727,379

(22) Filed: Mar. 26, 2007

(65) Prior Publication Data

US 2008/0238595 A1 Oct. 2, 2008

(51) Int. Cl.
*H01F 7/20* (2006.01)

(52) U.S. Cl. ..... 335/285; 335/286; 335/287; 335/288; 335/289; 335/290; 335/291; 335/292; 335/293; 335/294; 335/295

(58) Field of Classification Search ..... 335/285–295
See application file for complete search history.

(56) References Cited

U.S. PATENT DOCUMENTS 2,333,230 A * 11/1943 Beechlyn ..... 335/295
5,435,613 A * 7/1995 Jung ..... 294/65.5
6,076,873 A * 6/2000 Jung ..... 294/65.5
6,331,810 B1 * 12/2001 Jung ..... 335/288
6,854,777 B2 * 2/2005 Jung ..... 294/65.5
7,009,480 B2 * 3/2006 Tsui et al. ..... 335/287
7,049,919 B2 * 5/2006 Yamaki ..... 335/288
7,095,305 B2 * 8/2006 Shiao ..... 335/289
2006/0279390 A1 * 12/2006 Chang ..... 335/285

* cited by examiner

*Primary Examiner*—Elvin G Enad
*Assistant Examiner*—Mohamad A Musleh
(74) *Attorney, Agent, or Firm*—Muncy, Geissler, Olds & Lowe, PLLC

(57) ABSTRACT

A switch type ON/OFF structure for hoisting magnetic disks has a handle turnable towards one side to demagnetize and towards another side to generate a magnetic force to attract and move a work piece. The handle is hinged on one end surface of a hoisting magnetic disk which also has a first detent member and a second detent member. The first and second detent members can stop the turning of the handle. The handle further has an extensible latch member at one side spaced from the handle at a selected interval. The latch member has a distal end slidable over the second detent member and extendable downwards to allow the second detent member to be wedged in the interval and anchored. Thereby the hoisting magnetic disk can provide the magnetic attracting force and hoist and move the work piece safer.

3 Claims, 7 Drawing Sheets

SWITCH TYPE ON/OFF STRUCTURE FOR HOISTING MAGNETIC DISKS

FIELD OF THE INVENTION

The present invention relates to a hoisting magnetic disk and particularly to an ON/OFF structure that has a bar type switch to set magnetic force ON/OFF to attract work pieces and enhance safety.

BACKGROUND OF THE INVENTION

Many working sites in manufacturing industry have magnetic disks to hoist and move metal work pieces (such as cast iron or steel plate) due to the metal work pieces are heavy and difficult to move manually. The magnetic disk functions based on the interaction between N pole and S pole in which the magnetic lines of force of the same direction repulse each other while those of the opposite directions attract each other. The magnetic attracting force can attract the metal work pieces and move them to desired locations. Then a demagnetization process is performed to unload the work pieces. To accomplish this function a switch is provided on an outer side of the magnetic disk to control the direction of the magnetic lines of force of the N pole and S pole to generate magnetic attraction and demagnetization at the bottom of the magnetic disk. Operation of the switch to generate the magnetic attraction and demagnetization has to be done very carefully without any mistake. When the work pieces are being moved through the magnetic attraction, any improper operation could result in abrupt demagnetization and cause dropping of the work pieces from a high elevation and become dangerous. Hence ON/OFF design of the magnetic disk has to take into account of user operation methods and eliminate the possibility of mistake and abrupt demagnetization.

SUMMARY OF THE INVENTION

The primary object of the present invention is to provide an ON/OFF structure for switch type hoisting magnetic disks. It has a rotary handle in the middle of one end surface of a hoisting magnetic disk and a protrusive and strut type fist detent member and a second detent member located on the hoisting magnetic disk at the left side and right side of the handle to stop turning of the handle. The handle has a bottom end hinged on the hoisting magnetic disk and a bar type elastic latch member at one side. The latch member is spaced from the handle at a desired interval and extensible to allow a distal end thereof to slide over the second detent member and extended downwards so that the second detent member can be latched in the interval and anchored. Therefore the hoisting magnetic disk can provide a magnetic attracting force to hoist and move a work piece and maintain normal magnetic attraction. Such a design can enhance safety.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
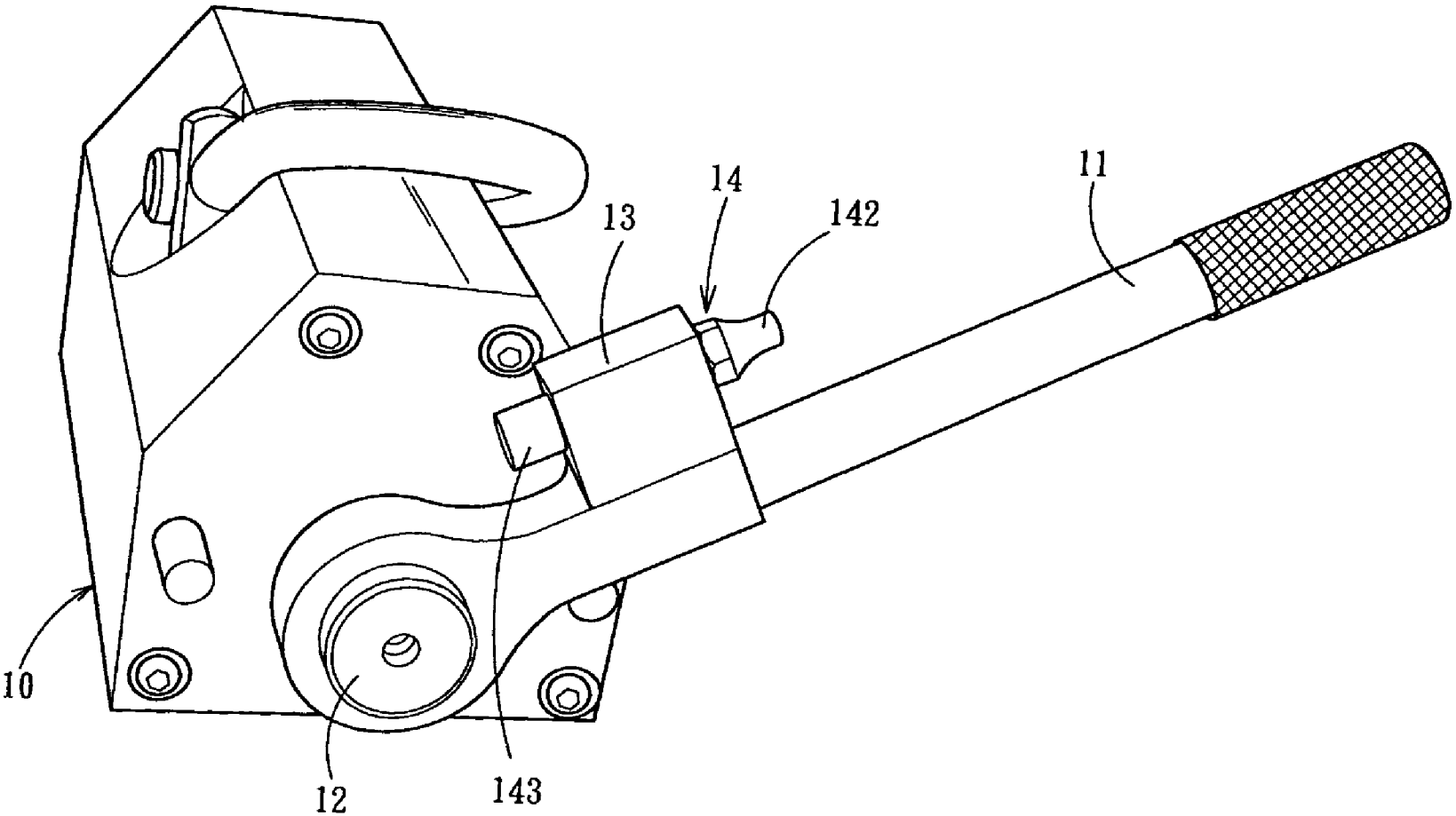
FIG. 1 is a perspective view of an embodiment of the invention.
Figure 2:
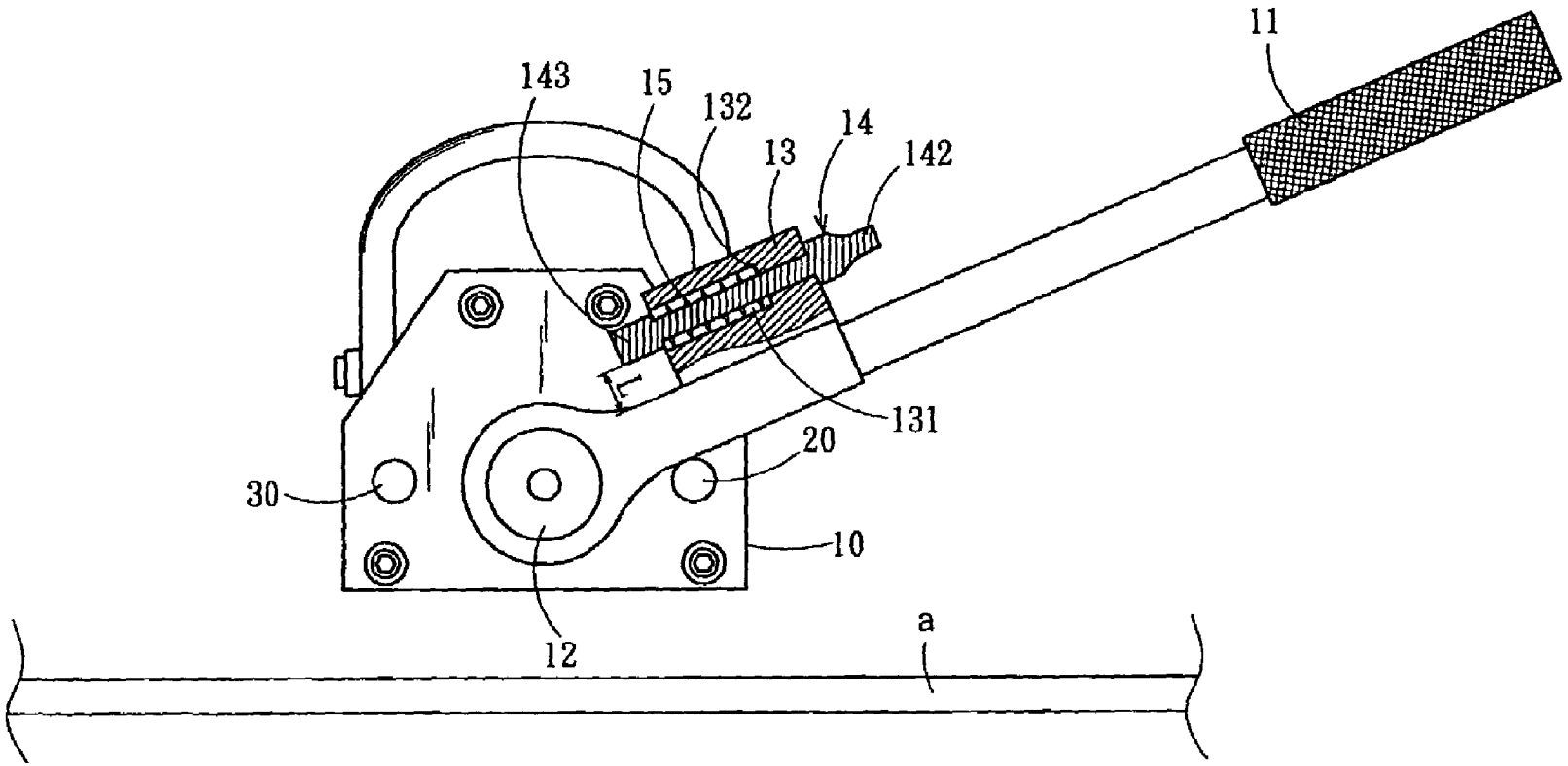
FIG. 2 is a fragmentary sectional view of an embodiment of the invention.

Please refer to FIGS. 1 and 2, the hoisting magnetic disk according to the invention includes:

a chest type hoisting magnetic disk 10 which has magnetic attracting force at the bottom to attract a metal work piece a;

a handle 11 which has a pivotal axle 12 at a bottom end to be hinged on one end surface of the hoisting magnetic disk 10 so that the handle 11 can be turned by a user's hand. The handle 11 has a boss 13 at one side above the pivotal axle 12. The boss 13 has a through hole 131 in parallel with the axis of the handle 11 to hold a bar type latch member 14. The latch member 14 is spaced from the handle 11 at an interval L;

an elastic member 15 (such as a spring) which is coupled on the periphery of the latch member 14. The through hole 131 has a top portion forming a bucking rim 132 at a diameter smaller than the bottom thereof. The latch member 14 has a handgrip 142 at the top portion to be grasped by a user's hand. The handgrip 142 is located at an upper side of the boss 13. The latch member 14 has a latch strut 143 at the bottom formed at a diameter larger than the middle portion thereof so that the top end of the elastic member 15 can press the bucking rim 132 while the bottom end presses the upper side of the latch strut 143;

a first detent member 20 which is a round strut and extended at the right side of the handle 11 to stop the handle 11 from turning continuously downward clockwise, and also to position the hoisting magnetic disk 10 in a non-magnetic attracting condition; and a second detent member 30 which is a round strut and extended at the left side of the handle 11 to stop the handle 11 from turning continuously downward counterclockwise, and also to position the hoisting magnetic disk 10 in a magnetic attracting condition.

By means of the construction set forth above, when in use and the hoisting magnetic disk 10 is not in a condition to attract the work piece a, the handle 11 is moved to the right side and stopped by the first detent member 20. The handle 11 is positioned diagonally towards the right side.

Figure 3A:
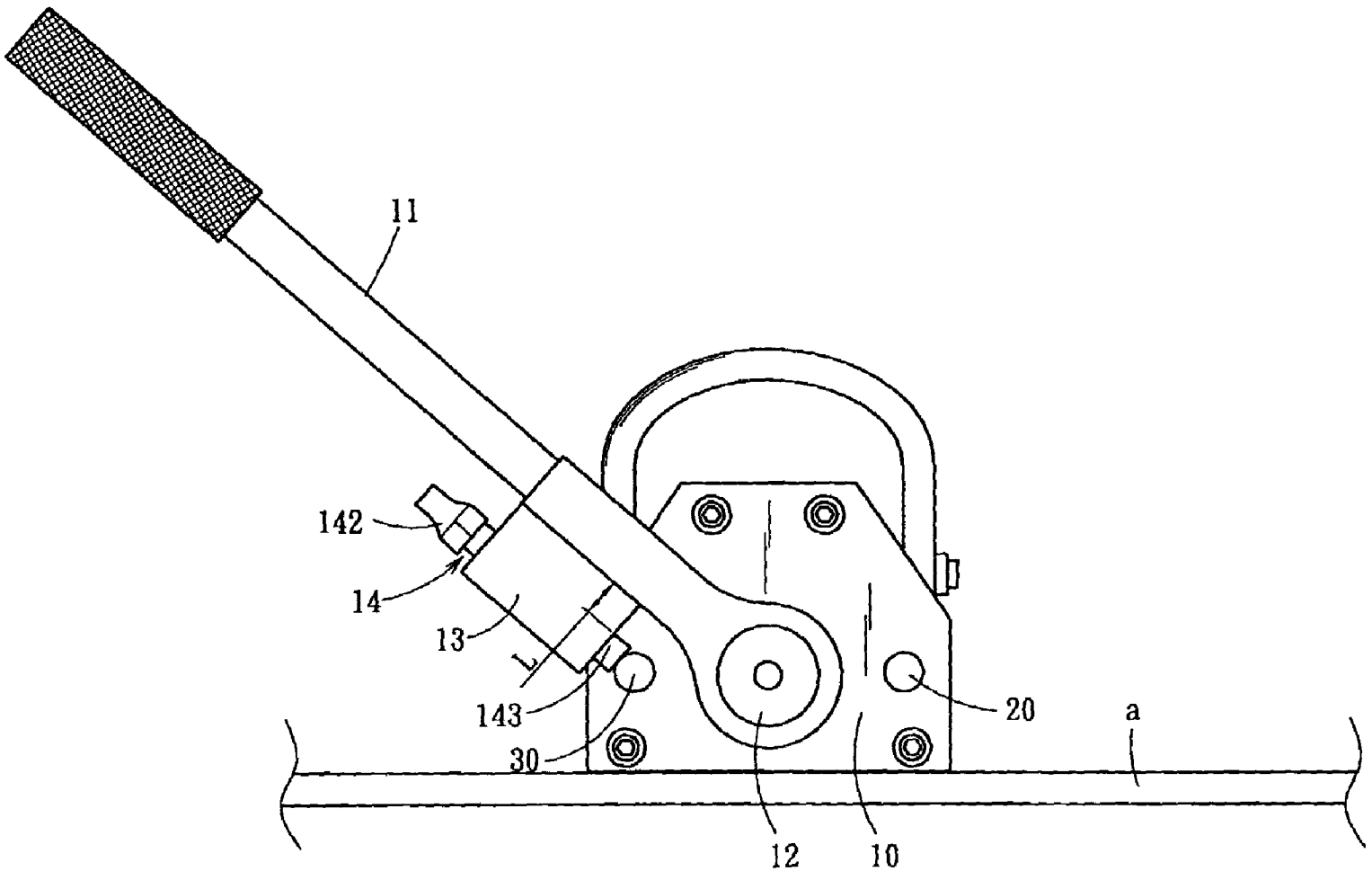
FIG. 3A is a plane view of an embodiment of the invention in an operating condition.
Figure 3B:
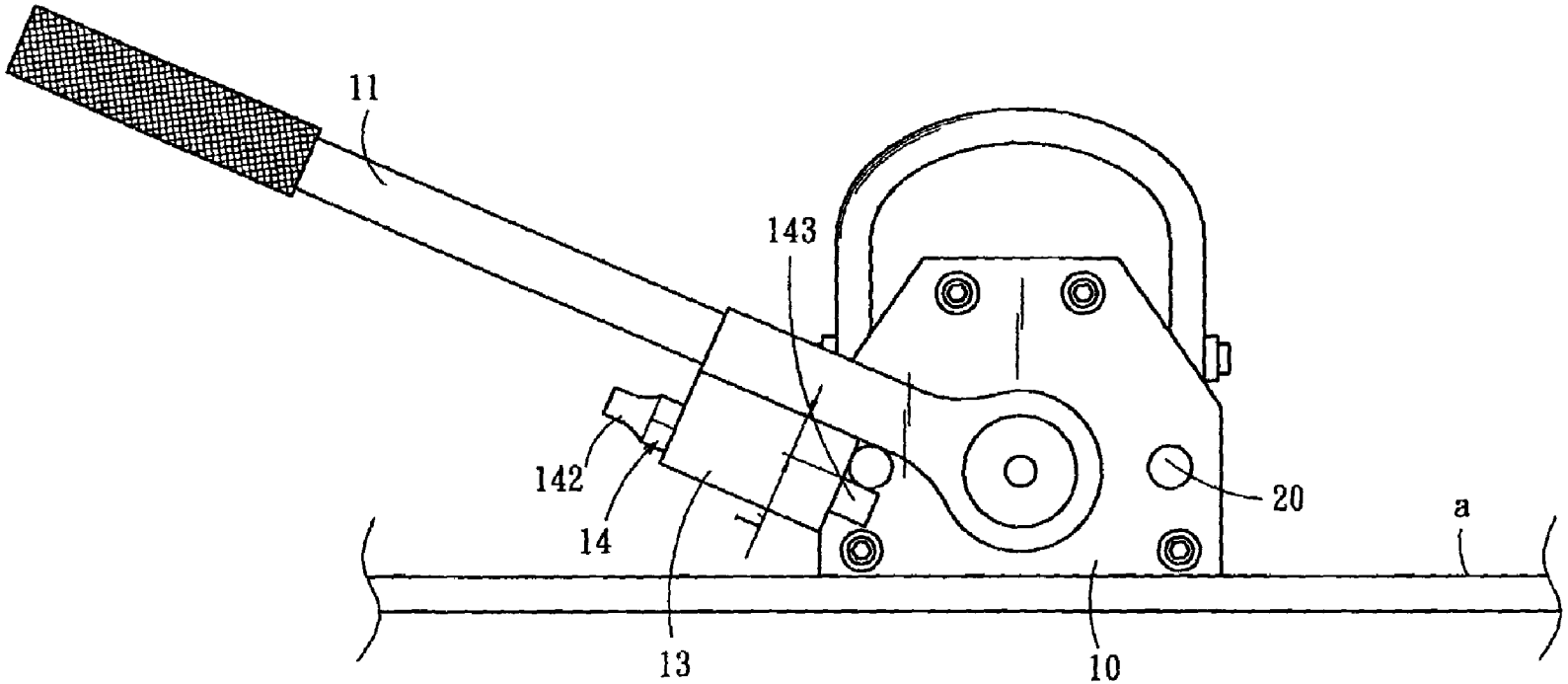
FIG. 3B is a plane view of an embodiment of the invention in another operating condition based on FIG. 3A.

When there is a desire to use the bottom of the hoisting magnetic disk 10 to attract the work piece a, the handle 11 is moved to the left side. Also referring to FIG. 3A, the latch member 14 is slid over the periphery of the second detent member 30 with the turning of the handle 11. User's hand has to pull the handgrip 142 upwards to allow the distal end of the latch member 143 to pass through the periphery of the second detent member 30. Meanwhile the elastic member 15 is pushed inwards and retracted. When user's hand is released, the return force of the elastic member 15 pushes the latch member 14 downwards again to allow the second latch member 30 to be latched in the interval L between the latch member 14 and the handle 11 and clipped as shown in FIG. 3B. Then the magnetic force at the bottom side of the hoisting magnetic disk 10 can attract the work piece a, and move it to a desired location. To unload the work piece a at the desired location, the hoisting magnetic disk 10 has to be demagnetized. This is accomplished by moving the latch member 14 upwards with one hand, while the handle 11 is moved rightwards to the original position by another hand to lean over the first detent member 20. Namely the latch member 14 has to be moved upwards and the handle 11 has to be moved rightwards at the same time to perform demagnetization.

When the hoisting magnetic disk 10 attracts the work piece a, the second detent member 30 is located in the interval L between the latch member 14 and the handle 11, the handle 11 is prohibited from turning counterclockwise downwards, and also cannot be moved clockwise upwards even if the latch member 14 is moved upwards. The handle 11 can move downwards due to its gravity force without turning reverse to the right side. Hence operation mistake and demagnetization can be prevented and incidental dropping of the work piece a can be avoided enhancing safety.

Figure 4:
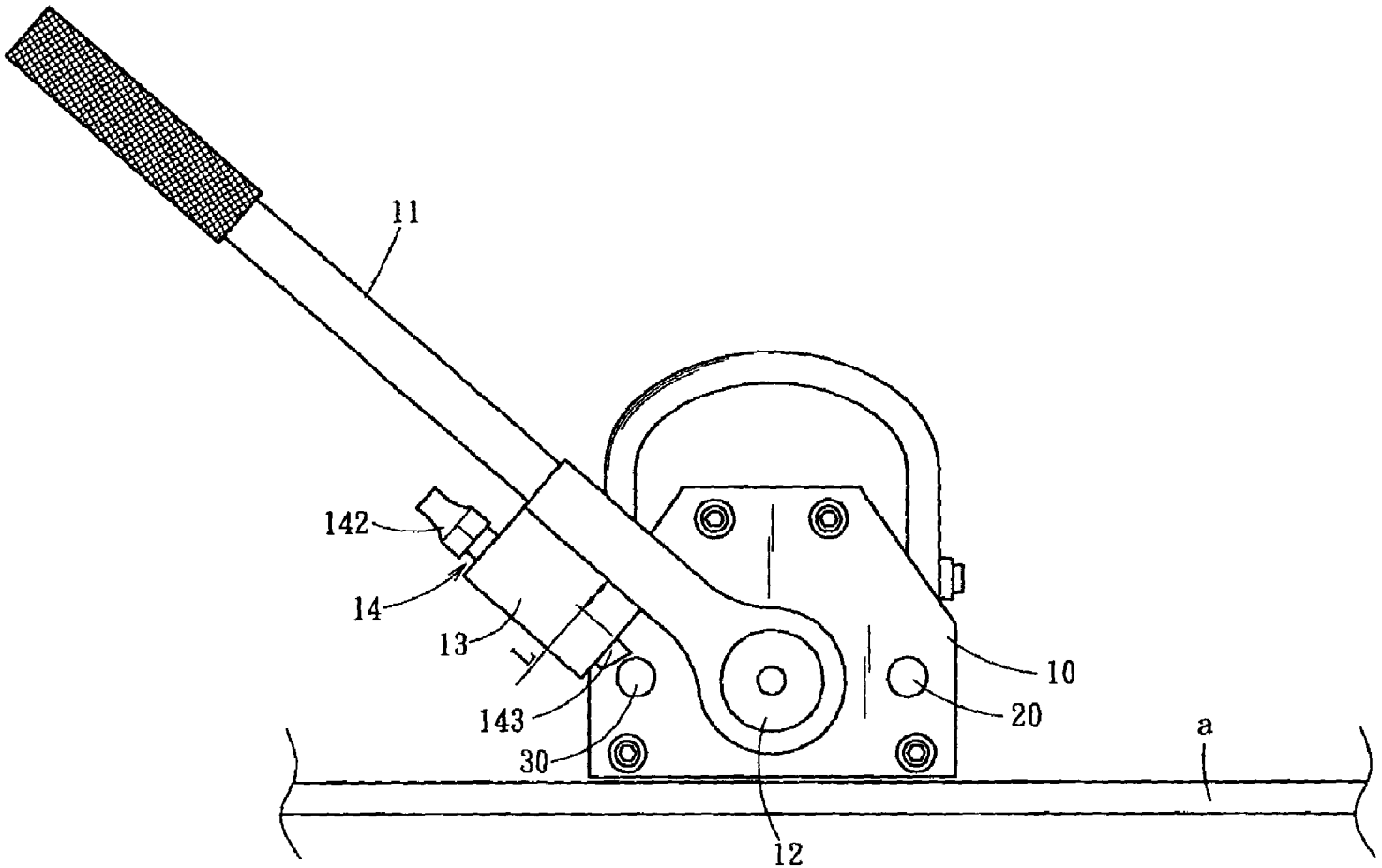
FIG. 4 is a plane view of a second embodiment of the invention.

Referring to FIG. 4, the bottom end of the latch member 14 may also be formed in a sloped surface or semi-circular surface. The latch member 14 may also be formed in a square shape or other desired shapes.

Figure 5A:
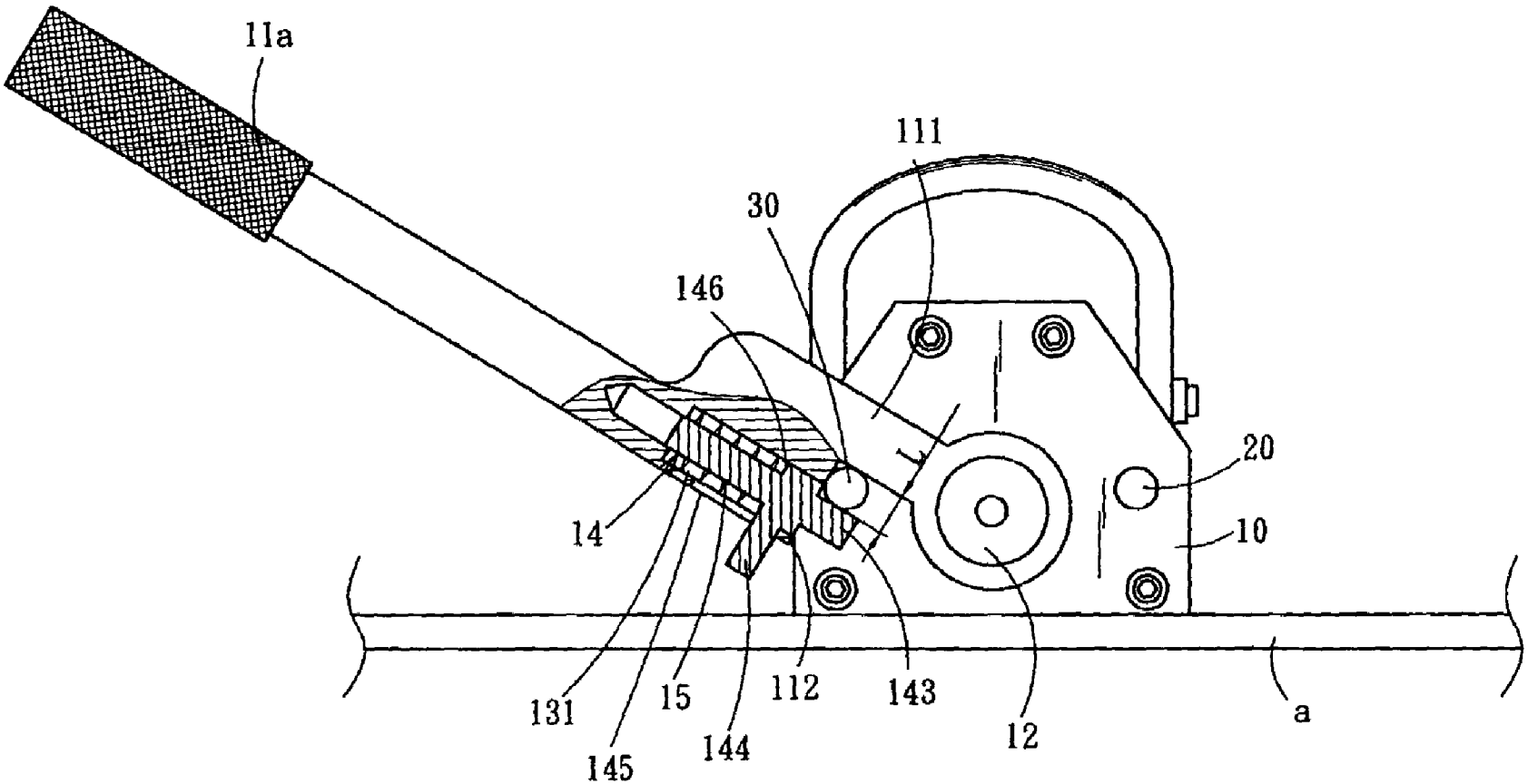
FIG. 5A is a plane view of a third embodiment of the invention.
Figure 5B:
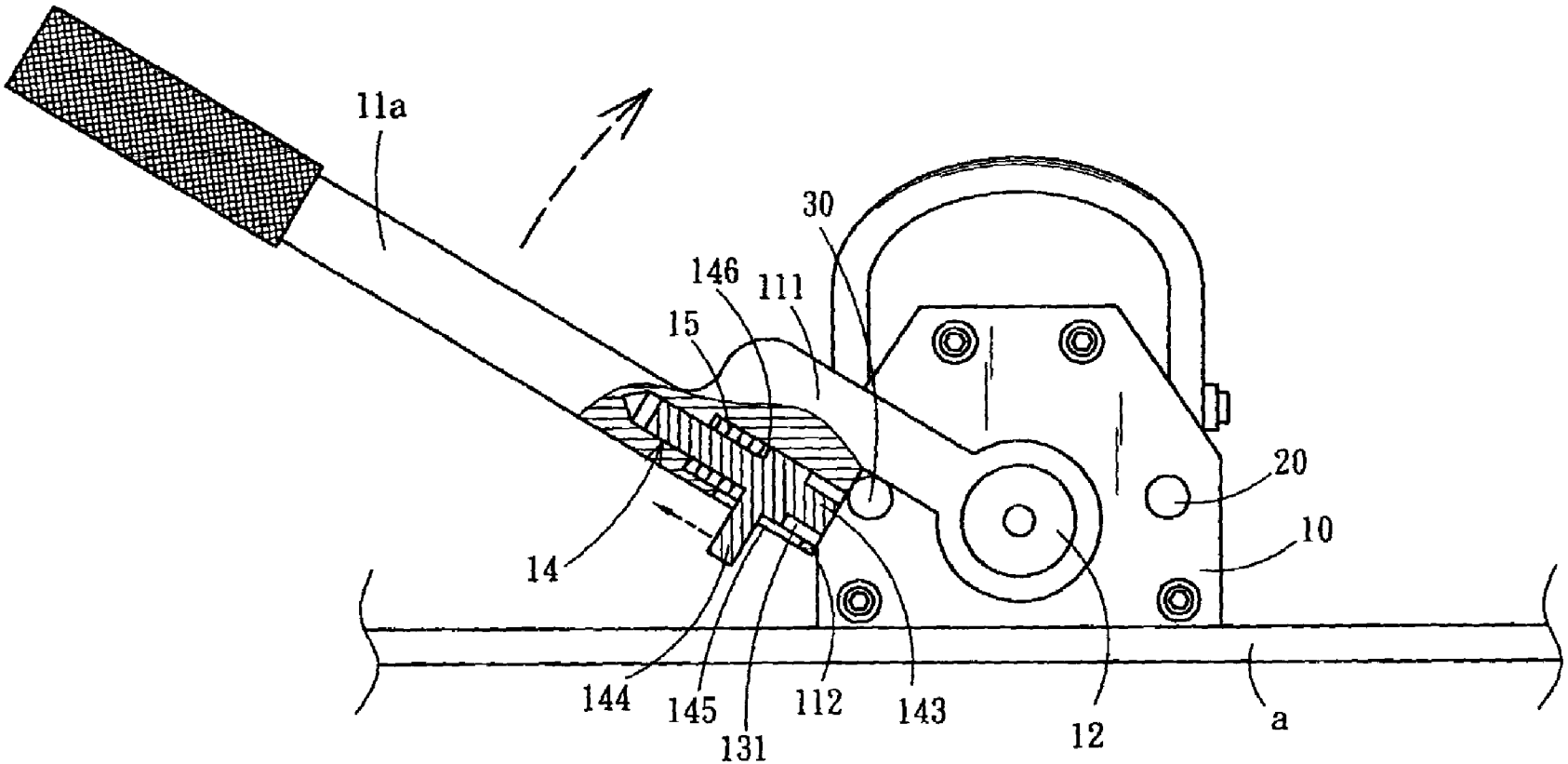
FIG. 5B is a schematic view according to FIG. 5A in an operating condition.

Refer to FIGS. 5A and 5B for a third embodiment of the invention. The bottom end of the handle 11*a* may be formed in N-shape so that the pivotal axle 12 of the handle 11*a* and the handle 11*a* are not coaxial. The handle 11*a* has a pivotal section 111 at a lower portion and a wedge surface 112 located at the bottom of the handle 11*a*. The wedge surface 112 has a cavity 131 to hold the latch member 14 and the elastic member 15. The elastic member 15 is coupled on the periphery of the latch member 14. The latch member 14 has a transverse lever 144 running through a slot 145 formed axially on the surface of the handle 11*a*, and a latch strut 143 at the bottom end thereof. An interval L is formed between the latch strut 143 and the handle 11*a* to hold the second detent member 30. Moreover, the latch member 14 has a harness portion 146 at a middle portion formed at a diameter larger than the diameter of the upper and lower sections of the latch member 14. The elastic member 15 has an upper end pressing the top portion of the cavity 131 and a lower portion pressing the upper side of the harness portion 146. Thus the latch strut 143 is extended outside the cavity 131.

Prototypes of the invention have been made according to the contents and drawings previously discussed. Test results indicated that the object and function set forth above have been satisfactorily accomplished. This invention provides a significant improvement over the conventional technique.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A switch type ON/OFF structure for hoisting magnetic disks, comprising:

a chest type hoisting magnetic disk which has a magnetic attracting force at the bottom thereof to attract a work piece;

a handle which has a pivotal axle at the bottom end to be hinged on one end surface of the hoisting magnetic disk and a boss formed at one side above the pivotal axle, the boss having a through hole to hold an extensible latch member which has a top portion movable upwards and forms an interval with the handle;

a first detent member formed in a round strut and extended at one side of the handle; and a second detent member formed in a round strut and extended at another side of the handle;

wherein the through hole has a top portion formed at a diameter smaller than the bottom thereof to form a bucking rim, the latch member having a handgrip at a top portion, the handgrip being located above the boss, the latch member having a latch strut at the bottom thereof, the latch strut having a diameter greater than a middle portion of the latch member, the latch member being coupled with an elastic member on an outer side, the elastic member having a top end pressing the bucking rim and a bottom end pressing an upper side of the latch strut.

2. The switch type ON/OFF structure for hoisting magnetic disks of claim 1, wherein the latch member has a sloped bottom surface.

3. The switch type ON/OFF structure for hoisting magnetic disks of claim 1, wherein the bottom end of the handle is formed in a N-shape, the handle having a pivotal section at a lower portion and a wedge surface at the bottom that has a cavity formed thereon, the cavity having an axial slot at one side wall, the latch member having a transverse lever running through the slot and a harness portion at a middle portion thereof formed at a diameter greater than the diameter of an upper portion and a lower portion of the latch member, the elastic member being coupled on an upper side of the harness portion.

* * * * *